US011807420B2

(12) United States Patent
Hathaway

(10) Patent No.: US 11,807,420 B2
(45) Date of Patent: Nov. 7, 2023

(54) COOLER ASSESSORY

(71) Applicant: James Hathaway, Alvin, TX (US)

(72) Inventor: James Hathaway, Alvin, TX (US)

( * ) Notice: Subject to any disclaimer, the term of this patent is extended or adjusted under 35 U.S.C. 154(b) by 0 days.

(21) Appl. No.: 17/243,082

(22) Filed: Apr. 28, 2021

(65) Prior Publication Data

US 2021/0339911 A1 Nov. 4, 2021

Related U.S. Application Data

(60) Provisional application No. 63/018,663, filed on May 1, 2020.

(51) Int. Cl.
*B65D 25/16* (2006.01)
*B65D 81/38* (2006.01)

(52) U.S. Cl.
CPC ..... *B65D 25/16* (2013.01); *B65D 81/3813* (2013.01)

(58) Field of Classification Search
CPC ..... B65D 25/16; B65D 81/3813; A45C 11/20; A45C 2013/026
USPC ..... 220/915.2, 23.86, 380, 8, 571, 607, 604; 62/459, 457.7, 457.1, 465, 464, 372; 206/557, 459.1, 503, 524.3; 248/346.01, 248/127, 163.1, 172; 211/60.1
See application file for complete search history.

(56) References Cited

U.S. PATENT DOCUMENTS 1,257,843 A * 2/1918 Gonyea ..... A47B 35/00 248/172
1,300,533 A * 4/1919 Wessinger ..... A47C 17/80 248/129
2,187,219 A * 1/1940 Bonsall ..... B61D 27/0081 105/375
3,698,330 A * 10/1972 Krombach ..... A47B 37/00 108/44
3,887,102 A * 6/1975 Earley ..... F25D 25/022 220/8
3,917,108 A * 11/1975 Thurman ..... B65D 19/0002 264/231
4,155,312 A * 5/1979 Thorkildson ..... A47B 45/00 D6/705
4,424,687 A * 1/1984 Morgan ..... F25D 3/08 62/457.1
4,565,074 A * 1/1986 Morgan ..... F25D 3/08 62/464
4,657,148 A * 4/1987 Heng ..... B42F 7/12 D19/92
4,907,703 A * 3/1990 Alger ..... B43M 99/001 211/10

(Continued)

*Primary Examiner* — Chun Hoi Cheung
*Assistant Examiner* — Brijesh V. Patel
(74) *Attorney, Agent, or Firm* — Brennan, Manna & Diamond, LLC

(57) ABSTRACT

This present invention relates to a modifiable, removable rack insert for an interior section of a cooler or ice chest. The rack insert supports game meat, fish and other items above the base of the cooler, thereby allowing dirt, grass and other debris to keep separate from the items stored on the rack. Additionally, the rack insert surface facilitates proper drainage of liquid and other debris therefrom so that the items stored thereon are not in contact with the same for extended periods of time. The modified rack insert is adjustable in size and can accommodate different sized coolers as per the requirements of its user.

16 Claims, 4 Drawing Sheets

(56) References Cited

U.S. PATENT DOCUMENTS 5,052,184 A * 10/1991 Jarvis ..... F25D 3/045 62/372
5,137,160 A * 8/1992 Santucci ..... A47B 45/00 211/175
5,140,914 A * 8/1992 Bohbot ..... A47C 7/70 108/44
5,160,026 A * 11/1992 Marsh ..... B25H 5/00 220/8
5,331,904 A * 7/1994 DiSimone ..... B25H 1/18 108/26
5,443,019 A * 8/1995 Sheldrick ..... B25H 5/00 108/44
5,469,999 A * 11/1995 Phirippidis ..... B60R 5/04 248/129
D377,028 S * 12/1996 Monday ..... D15/90
5,931,333 A * 8/1999 Woodnorth ..... A47J 43/24 220/DIG. 27
D417,124 S * 11/1999 Chen ..... 99/421 H
6,050,663 A * 4/2000 Schoellmann ..... F25D 3/08 312/351
6,062,146 A * 5/2000 Conners ..... B60R 7/02 296/37.16
6,126,124 A * 10/2000 Wagner ..... A45C 11/20 248/163.1
6,138,858 A * 10/2000 Tu ..... B25H 3/02 220/505
D448,249 S * 9/2001 DeCastro ..... D7/605
6,405,557 B1 * 6/2002 DeCastro ..... B65D 1/36 62/457.2
6,406,083 B2 * 6/2002 Bharj ..... B60R 5/044 296/37.16
6,619,773 B2 * 9/2003 Amsterdam ..... B42F 15/007 312/348.3
6,626,006 B1 * 9/2003 Tedder ..... F25D 3/08 220/915.2
6,691,884 B1 * 2/2004 Dwyer ..... F25D 3/08 220/4.03
D493,256 S * 7/2004 Kim ..... D28/61
6,811,232 B2 * 11/2004 Doan ..... A47B 88/994 312/348.3
7,178,673 B1 * 2/2007 Miller ..... A45C 11/20 206/545
7,313,928 B2 * 1/2008 Girard ..... F25D 3/08 62/457.7
7,523,900 B1 * 4/2009 Hlatky ..... A61G 7/0503 248/200.1
7,628,033 B1 * 12/2009 Skeels ..... F25D 3/08 62/457.1
8,065,889 B1 * 11/2011 Silberman ..... F25D 3/08 62/457.7
8,337,694 B1 * 12/2012 Sykes ..... E04C 2/427 210/170.03
D689,327 S * 9/2013 Ortegon ..... D7/667
D708,911 S * 7/2014 Rodriguez ..... A47G 19/22 D7/667
9,408,498 B2 * 8/2016 Sekora ..... A47J 37/1295
D767,341 S * 9/2016 Koempel ..... F25D 3/08 D7/554.3
10,054,353 B2 * 8/2018 Kendrick ..... F25D 3/045
10,077,934 B1 * 9/2018 Dizon ..... F25D 25/005
10,612,828 B1 * 4/2020 Engelbrect ..... F25D 25/02
11,078,006 B1 * 8/2021 Young ..... B65D 81/262
D931,058 S * 9/2021 Hamilton ..... A47G 23/04 D7/554.3
11,219,326 B1 * 1/2022 Gutierrez ..... A47G 23/04
2002/0000289 A1 * 1/2002 Nickell ..... A43B 23/07 156/244.13
2009/0314913 A1 * 12/2009 Gillis ..... G06F 3/0395 248/346.01
2010/0176022 A1 * 7/2010 Furlong ..... B65D 25/24 206/508
2011/0005962 A1 * 1/2011 Hirz ..... B65D 25/24 220/601
2011/0155602 A1 * 6/2011 Sterry ..... A61J 7/0436 206/459.1
2012/0164201 A1 * 6/2012 Harris ..... A61L 2/232 424/618
2015/0291806 A1 * 10/2015 Turner ..... A47G 19/22 220/604
2017/0023292 A1 * 1/2017 Marinelli ..... F25D 3/08

* cited by examiner

COOLER ASSESSORY

CROSS-REFERENCE TO RELATED APPLICATION

The present application claims priority to, and the benefit of, U.S. Provisional Application No. 63/018,663, which was filed on May 1, 2020 and is incorporated herein by reference in its entirety.

FIELD OF THE INVENTION

The present invention relates generally to the field of portable coolers. More specifically, the present invention relates to a rack or tray insert for a chest or portable cooler that is designed to suspend or hold game meat, fish and other items at a level above the base or floor of the cooler. By holding the contents above the base, the rack or tray prevents viscous liquids, dirt, grass and other debris from gathering in the bottom of the cooler and blocking the exit drain or valve. The rack insert of the present invention also keeps game meat and fish both cold and suspended above the blood, hair and other debris that may accumulate at the bottom of the cooler while the suspended meat is bleeding. The uniquely designed rack insert has rounded corners and a checker-style pattern with a groove on the bottom to secure within the interior, while still allowing liquids to drain to the base of the cooler where they are discharged through the drain valve. Additionally, the rack insert is adjustable in size, and its dimensions such as length, width and height can be modified via telescopic mechanisms to fit different cooler or container sizes and/or configurations. Accordingly, the present disclosure makes specific reference thereto. Nonetheless, it is to be appreciated that aspects of the present invention are also equally applicable to other like applications, devices and methods of manufacture.

BACKGROUND OF THE INVENTION

By way of background, portable ice chests or containers (also known as coolers, ice boxes, cool boxes or chilly bins) are typically an insulated box or other shaped container used to keep food, drink or other contents such as medicine, meat and other perishable items cool. Further, portable ice chests have been used for years by campers, fishermen, emergency and healthcare personnel and the like for keeping consumer products and other items cold. Campers, hunters and fishermen often use the ice chests for keeping game meat and fish at a desired temperature, so as to be able to later cook the product without concerns over spoilage. However, storing game meat and fish in a standard cooler can be difficult, messy and frustrating. Grass, hair, and dirt can be strewn about the cooler and contaminate the meat or other items stored inside. The contaminated meat or fish becomes unhygienic and difficult to manage for later use. In addition, in medical applications, maintaining organs for transplant and keeping medicines such as vaccines suspended above the base of the cooler allows for air circulation around the items to maintain even cooling as well as avoiding contamination from melting ice or other thawing cold packs.

Typically, ice chest coolers use ice cubes or other cold packs inside an insulated box to help the contents inside to stay cool. The ice will melt over time, and the cold packs will thaw, creating condensation, which causes the food or other items in contact with the ice or cold packs to become soggy, thereby reducing the freshness and flavor of food or other items. Additionally, game meat and fish may bleed out, which may cause blood or other fluids to collect at the bottom surface or base of the cooler, thereby causing premature spoilage of the meat or fish. Further, the bleeding out of the game meat and/or fish makes the cooler unsanitary and not available for use again until cleaned and sanitized.

Additionally, fish sit in viscous liquids and slime, thereby causing dirt to accumulate on the bottom of the cooler. The cooler may be unable to drain properly if debris is blocking the drain or exit valve. When game meat is kept in the cooler, the viscous liquids, blood, dirt, grass and other debris may gather at the bottom of the cooler. The accumulated waste contaminates the cooler, rendering it unhygienic and reducing the desirability to store or keep game meat, fish or other consumer products (e.g., beverages) inside the ice chest. Available conventional trays are fixed in size, causing consumers to have to buy multiple trays of different sizes to accommodate different sized coolers. Purchasing multiple trays can become expensive and inconvenient.

Currently, campers, hunters, fishermen and others have to manually remove the gathered waste such as viscous liquids, slime, debris, grass, blood and water from the cooler bottom, and then manually sanitize the cooler before the next use. Manual cleaning is both time-consuming and frustrating for individuals. Therefore, conventional ice chest coolers are inconvenient to use and reduce the quality of the meat, fish and other items stored therein.

Therefore, there exists a long felt need in the art for a cooler accessory that can be used to conveniently store game meat, fish and other items inside the cooler or other insulated container. There is also a long felt need in the art for a cooler rack that enables the stored meat, fish and other items to be suspended above the blood, dirt, grass, water and other debris that may collect in the bottom portion of the cooler. Additionally, there is a long felt need in the art for a cooler rack that facilitates the proper draining of viscous liquids, slime, debris, blood and more from the game meat or fish stored inside the cooler. Moreover, there is a long felt need in the art for a cooler rack that is adjustable in size to accommodate different sizes and configurations of coolers. Furthermore, there is a long felt need in the art for a cooler rack that ensures that the food stored thereon remains fresh and maintains its flavor, and does not become contaminated by coming into contact with the bottom surface of the cooler. Finally, there is a long felt need in the art for a cooler accessory that is relatively inexpensive to manufacture, and that is both safe and easy to use.

The subject matter disclosed and claimed herein, in one embodiment thereof, comprises a novel cooler accessory to be kept inside a cooler or ice chest and that is designed to hold food and other items above the base surface or bottom of the cooler or ice chest. The cooler accessory comprises a plurality of vertical and horizontal ribs to form a substantially rectangular tray surface. Multiple drainage gaps in the surface of the tray are formed by the intersection of the various vertical and horizontal ribs. Additionally, the side surfaces extend around the perimeter of the tray surface, with each side surface having a plurality of support legs to rest on the base surface of the cooler or ice chest. A groove is also provided between every two consecutive support legs, framing the tray surface above the grooves on the side surfaces so that when food or other items are placed on the tray surface, the items remain above the base surface of the cooler or ice chest and free from contamination.

In this manner, the novel cooler accessory of the present invention accomplishes all of the forgoing objectives, and provides a relatively easy, convenient and cost-effective solution to storing game meat and/or fish inside a cooler or ice chest in a hygienic manner. The cooler accessory of the present invention is also user friendly, inasmuch as the rack insert supports the game meat, fish or other items above the base inside the cooler, thereby allowing blood, dirt, grass, and other debris to be easily washed off and drained from the cooler or ice chest via the drain plug. Additionally, the rack insert prevents the stored game meat, fish or other items from coming into contact with the melting ice, blood or other debris that may otherwise collect at the bottom of the cooler, thereby maintaining the freshness and flavor of the stored items. Finally, the rack insert is adjustable in both size and configuration to suit the needs and/or preferences of the user and fits various different cooler/ice chest types and sizes.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a novel tray insert to be kept inside a cooler or ice chest that is designed to hold food and other items above the base surface of the cooler or ice chest. The novel rack or tray includes a plurality of vertical and horizontal ribs to form a substantially rectangular tray surface, and a plurality of drainage gaps in the surface of the tray that are formed by the intersection of the various vertical and horizontal ribs. The novel rack or tray further comprises a plurality of side surfaces disposed around the periphery of the tray surface, wherein each side surface has a plurality of support legs to position the tray or rack over the base surface of the cooler or ice chest. A groove is also provided between every two consecutive support legs, wherein the tray surface is framed above the grooves present on the side surfaces so that the food or other items placed on the tray surface remain above the base surface of the cooler or ice chest.

In a further embodiment of the present invention, a telescopic rack tray insert designed to hold food and other items above a base surface of the cooler or ice chest is disclosed. The telescopic rack tray comprises substantially rectangular upper and lower tray portion. The upper tray portion and the lower tray portion each have a tray surface having a plurality of drainage gaps located thereon and a plurality of supporting legs on their side surfaces. The side surfaces of the upper tray portion slide over the side surfaces of the lower tray portion to increase or decrease the length of the rack/tray insert to fit various sizes and configurations of coolers and ice chests. The sliding mechanism is further comprised of one or more locks such that the supporting legs of both the upper and lower tray portions coincide with each other upon locking the sliding mechanism.

In yet a further embodiment of the present invention, a method of placing game meat, fish and/or other items above a base surface of a cooler or ice chest is disclosed. The method comprises the initial steps of providing a reconfigurable rack tray insert to be placed on a base surface of the cooler or ice chest. The tray or rack has a plurality of vertical and horizontal ribs to form a substantially rectangular tray surface that has a plurality of drainage gaps therein, formed by the intersection of the vertical and horizontal ribs. The tray or rack is further comprised of a plurality of side surfaces that extend around the periphery of the tray surface, wherein each side surface has a plurality of support legs which rest on the base surface of the cooler or ice chest. Additionally, a groove is provided between every two consecutive support legs. Next, the reconfigurable tray is manipulated/resized so that it fits within the cooler, and the meat, fish and other items are then placed on the top surface of the tray, such that the items only touch the tray surface and not the potentially contaminated base surface of the cooler or ice chest.

In a further embodiment of the present invention, a cooler and removable tray combination is disclosed. The combination comprises a cooler having a base, a top and a plurality of sidewalls extending upward from the base to the top to define an interior space, wherein the cooler is preferably integrally formed and has a geometric shape, such as a cube. The cooler further comprises a drain or valve opening that extends from the interior space to the exterior of the cooler. The combination further comprises a removable and reconfigurable tray that may be sized and configured to fit within the interior space of the cooler and rest on the base. The tray has a surface with a plurality of openings and sidewalls, with the sidewalls extending both above and below the surface of the tray. The sidewalls preferably have an undulating pattern and a plurality of gaps, wherein each of the plurality of gaps is adjacent to a supporting foot.

In still another embodiment of the present invention, a removable rack tray or support insert to prevent food or other items from touching the unhygienic base surface of a cooler, container or ice box is disclosed. The insert comprises a substantially rectangular shaped tray surface. However, the tray may be of any shape depending on the outer shape of the cooler such as round, square or the like. The tray includes a plurality of supporting legs with grooves between every two consecutive supporting legs. The upper tray surface is at least 2-3 inches above the base surface of the cooler when properly positioned in the interior of the cooler. Additionally, the tray surface can be extended both in the longitudinal and lateral or transverse directions by sliding an upper portion of the tray insert on the lower portion of the tray insert to increase the surface area of the tray.

The removable and extendable rack insert of the present invention provides users with a support for game meat, fish and other items above the base of a cooler or ice chest, thereby allowing blood, dirt, grass and other debris to be easily washed off and removed from the cooler via the drain opening. The rack or tray insert has a checker-style pattern with grooves on the bottom, to facilitate proper drainage of unwanted liquids and debris. Due to its reconfigurability, the rack or tray can be installed and removed from the interior of the cooler with relative ease, and washed in a sink or dishwasher with warm water and soap. The height, length and width of the rack can be adjusted via its telescopic mechanisms.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
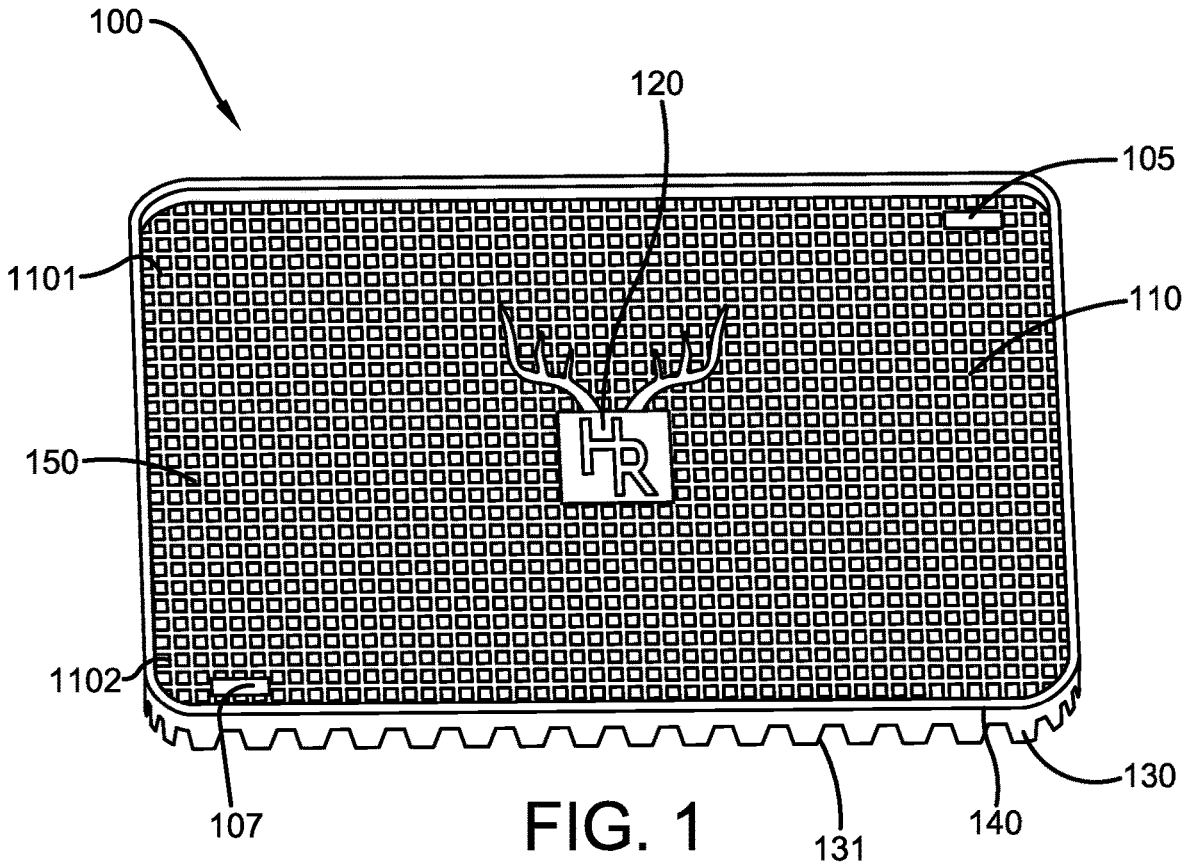
FIG. 1 illustrates a perspective view of one potential embodiment of the novel rack insert for a cooler or ice chest of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a cooler accessory that can be used to conveniently store and clean (or at least rinse) game meat, fish and other items inside the cooler or other insulated container. There is also a long felt need in the art for a cooler rack that enables the stored meat, fish and other items to be suspended above the blood, dirt, grass, water and other debris that may gather in the bottom portion of the cooler. Additionally, there is a long felt need in the art for a cooler rack that facilitates the proper draining of viscous liquids, slime, debris, blood and more from game meat or fish stored inside the cooler. Moreover, there is a long felt need in the art for a cooler rack that is adjustable in size to accommodate different sizes and configurations of coolers. Furthermore, there is a long felt need in the art for a cooler rack that ensures that the food stored thereon remains fresh and maintains its flavor, and does not become contaminated by coming into contact with the bottom surface of the cooler. Finally, there is a long felt need in the art for a cooler accessory that is relatively inexpensive to manufacture, and that is both safe and easy to use.

The present invention, in one exemplary embodiment, is a novel cooler accessory in the form of a rack or tray insert that can be positioned inside a cooler or ice chest and is designed to hold food, consumer products, medicines (e.g. vaccines), organs for transplant and other items above the base surface of the cooler or ice chest so that cool air can freely circulate around the contents that are disposed on the tray, thereby maintaining the integrity of the stored items. The tray or rack of the present invention includes a plurality of vertical and horizontal ribs that form a substantially rectangular or other geometrically shaped tray surface. A plurality of draining gaps in the tray surface are also formed by the intersection of the vertical and horizontal ribs. Side surfaces extend around the periphery of the tray surface, wherein each side surface has a plurality of support legs that rest on the base surface of the cooler or ice chest. A groove is provided between every two consecutive support legs, framing the tray surface above the grooves that are present on the side surfaces, such that the food or other stored items placed on the tray surface remain above the base surface of the cooler or ice chest, thereby allowing liquids and debris to fall to the bottom of the cooler to drain, while also permitting the circulation of cool air around the stored items.

Referring initially to the drawings, FIG. 1 illustrates a perspective view of one potential embodiment of the novel rack insert 100 for a cooler or ice chest 400 of the present invention in accordance with the disclosed architecture. The novel rack insert 100 is designed to suspend game meat, fish and other items above the base surface of the cooler 400. In a preferred embodiment, the rack insert 100 is substantially rectangular in shape with rounded corners, and is designed and configured to fit within the interior area of the cooler 400. Notwithstanding, additional geometric shapes, such as circular, oval, square or the like are also possible, and the tray insert 100 can be shaped in a corresponding configuration.

The novel tray 100 has a checker-style patterned tray surface 110 having a plurality of vertical ribs 1102 and a plurality of horizontal ribs 1101. The plurality of vertical ribs 1102 and plurality of horizontal ribs 1101 intersect with each other to form drainage gaps 150 across the tray surface 110. Game meat, fish and other items can be easily placed on the checker-style pattern tray surface 110, wherein the blood, liquid, slime and other debris can be drained from the items through the drainage gaps 150 to the bottom surface of the cooler for further drainage from the cooler.

Each side surface 140 of the rectangular rack insert 100 has a plurality of support legs 130, wherein each of the plurality of support legs 130 legs has a generally flat surface to place on the cooler base or bottom. The support legs 130 are continuous and extend around the periphery of the tray base, giving a stable placement of the rectangular rack insert 100 within the cooler 400. There is also an undulating pattern 131 of gaps or grooves along the support legs 130 so that the blood and other debris from the stored items can be easily drained and does not collect on the cooler base. In addition, the undulating pattern 131 allows air to pass under the tray, allowing the cool air to circulate beneath the tray or rack insert 100 and the items stored thereon.

The checker-style patterned tray surface 110 is preferably rigid and can support multiple items at the same time. The rack 100 is placed on the cooler base such that the tray surface 110 is a certain height above the cooler base and the meat, fish and other items stored thereon do not come into contact with the potentially contaminated cooler base. In this manner, the meat, fish and other items do not sit in viscous liquids and slime, or lay in dirt or other debris on the base of the cooler or ice chest. The rack 100 is dimensioned to fit within the interior of a cooler or ice chest and, as explained more fully below, is also fully reconfigurable.

The long side surfaces are parallel to each other and the two short side surfaces are also parallel to each other with four rounded corners. Each drainage gap 150 is preferably of the same size, but can alternatively be of different sizes based on the intersection of the plurality of vertical ribs 1102 and horizontal ribs 1101. At the center of the tray surface 110, a logo or trademark 120 may be present that can be used for marketing and aesthetic appeal. The tray surface 110 may include an anti-microbial coating or other material that is integrated into the tray during manufacture. An exemplary anti-microbial coating is marketed under the name MicroBan®. Nonetheless, other anti-microbial, anti-fungal and/or anti-bacterial material may also be used, or there may be a combination of such materials used with the tray surface 110.

The rack or tray insert 100 allows for the proper drainage of blood, liquids, material or relatively small particulate through the drainage gaps 150 in the tray surface 110, and keeps the game meat, fish and other items separated from the blood, hair and other debris that may bleed or leach out the meat, fish, etc., or otherwise accumulate at the bottom of the cooler 400. The rack insert 100 may comprise a thermometer 105 so that an individual may check the interior temperature of the cooler at any time. Additionally, the rack insert 100 may also comprise one or more sensors 107 which can be used to detect moisture levels, bacterial levels, time, light exposure and other conditions and alert the user of the same.

Figure 2:
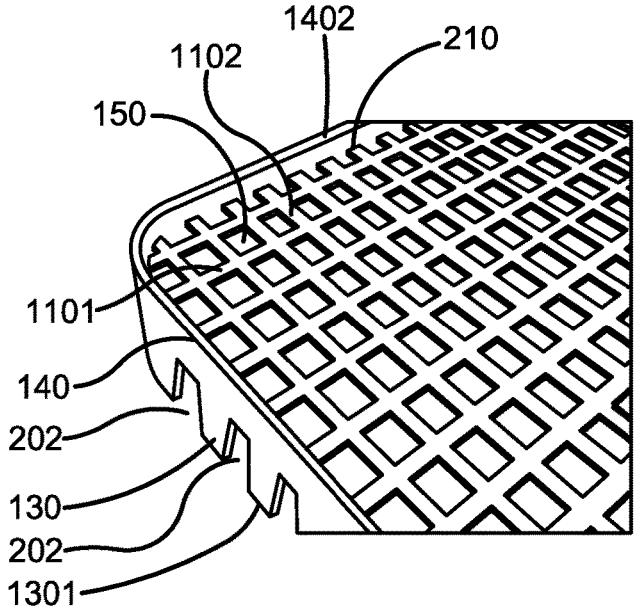
FIG. 2 illustrates a close-up partial perspective view of one potential embodiment of the novel rack insert for a cooler or ice chest of the present invention in accordance with the disclosed architecture, wherein the various intersections of the horizontal and vertical ribs are clearly visible.

FIG. 2 illustrates a close-up partial perspective view of one potential embodiment of the novel rack insert 100 for a cooler or ice chest 400 of the present invention in accordance with the disclosed architecture, wherein the various intersections of the horizontal and vertical ribs 1101, 1102 are clearly visible along with the drainage gaps 150. As shown, the side surface 140 is relatively thick with the horizontal ribs 1101 and the vertical ribs 1102 attached to the interior surface of the side surface at 210. It should be noted that the preferable point of attachment 210 is below the top portion 1402 of the side surface 140, but above the support legs 130.

The drainage gaps 150 are formed due to the intersection of the horizontal ribs 1101 and the vertical ribs 1102, wherein each drainage gap 150 is similar in both shape and dimensions, and ranges in size from between ½" L×½" W to 1" L by 1" W. Each of the drainage gaps 150 should be sufficiently small so that the items do not get trapped in said gaps, thereby making removal of the items difficult, but not so big that the items cannot be supported by the tray surface 110. Each supporting leg 130 has a relatively flat base surface 1301 that rests on the bottom cooler surface or any other surface when the rack insert 100 is placed inside the cooler or ice chest 400. A groove or gap 202 which makes up an undulating and repeating pattern 131 is present between the adjacent supporting legs 130 to allow any debris or blood to easily pass under the rack insert 100 and easily drain from the cooler base. The undulating pattern 131 also allows for the passage of air underneath the rack insert 100 to maintain the flow of cool air around the items being rinsed or stored on the rack insert 100.

All of the supporting legs 130 are spread evenly across the long side surfaces. The two short side surfaces and are generally symmetrical to one another, with grooves or gaps 202 of the approximately same size positioned between each adjacent supporting leg 130. The gaps are shaped so as to be wider at the bottom of the gap and narrower at the top of the gap. Since the supporting legs 130 support the rack insert 100 on a surface, the tray surface 110 of the rack insert 100 does not touch the bottom surface of the cooler or ice chest 400, thereby preventing the game meat, fish or other items placed on the rack from sitting in debris for extended periods of time.

Figure 3:
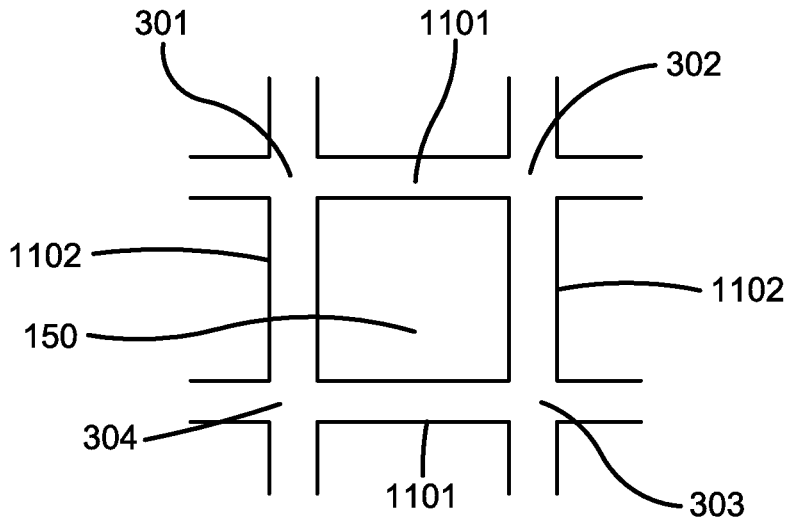
FIG. 3 illustrates a close-up partial perspective view of one potential embodiment of the drainage gaps of the novel rack insert for a cooler or ice chest of the present invention in accordance with the disclosed architecture.

FIG. 3 illustrates a close-up partial perspective view of one potential embodiment of the drainage gaps 150 of the novel rack insert 100 for a cooler or ice chest 400 of the present invention in accordance with the disclosed architecture. As stated previously, each horizontal rib 1101 and vertical rib 1102 intersects with one another to create the various drainage gaps 150. As shown, the horizontal ribs 1101 and the vertical ribs 1102 intersect with one another at intersection points 301, 302, 303, 304 to form each of the drainage gaps 150 from where blood, liquids, materials and other debris are drained onto the floor of the cooler 400, thereby preventing the meat, fish and other items on the rack surface 110 from sitting in debris for extended periods of time. The drainage gaps 150 are generally square in shape, but may be formed of any other geometric or non-geometric shape.

Figure 4:
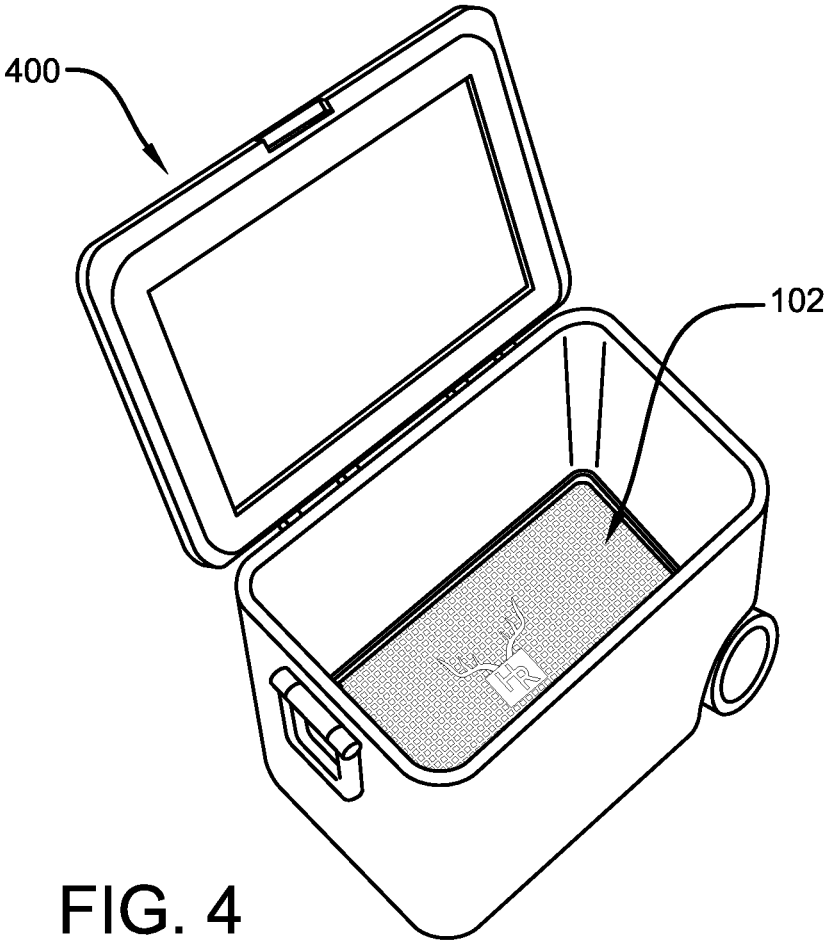
FIG. 4 illustrates a perspective view of one potential embodiment of the novel rack insert for a cooler or ice chest of the present invention in accordance with the disclosed architecture, wherein the rack insert is positioned in the interior of a portable cooler.

FIG. 4 illustrates a perspective view of one potential embodiment of the novel rack insert 100 for a cooler or ice chest 400 of the present invention in accordance with the disclosed architecture, wherein the rack insert 100 is positioned in the interior of a portable cooler 400. The rack insert 100 is dimensioned to be placed inside a cooler 400 and is placed on the base surface of the cooler while resting on the supporting legs 130. After placing the rack insert 100 on the base surface of the cooler 400, game meat, fish and other items may be placed on the tray surface 110 for safe and convenient cleaning and storage.

Figure 5:
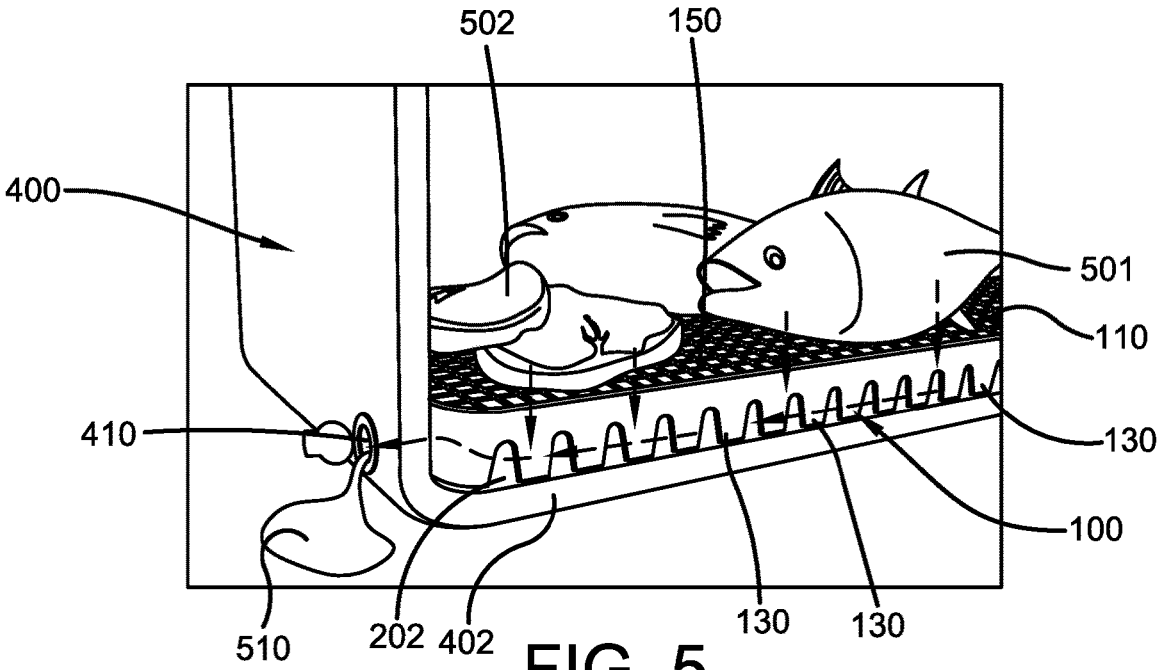
FIG. 5 illustrates a close-up partial perspective view of one potential embodiment of the novel rack insert for a cooler or ice chest of the present invention in accordance with the disclosed architecture, wherein the rack insert is positioned along the bottom of the cooler and is used to support game meat and fish above the bottom surface of the cooler and wherein the drain opening is used to drain the blood, water and other unwanted debris from the cooler.

FIG. 5 illustrates a close-up partial perspective view of one potential embodiment of the novel rack insert 100 for a cooler or ice chest 400 of the present invention in accordance with the disclosed architecture, wherein the rack insert 100 is positioned along the bottom of the cooler 400 and is used to support game meat and fish above the bottom surface of the cooler and wherein the drain opening 410 empties the cooler 400 of blood, water and other unwanted debris. As shown, the rack insert 100 is placed on the base surface 402 of the cooler 400 with the supporting legs 130 (marking is done for only a few supporting legs for simplicity) touching the base surface 402 of the cooler bottom or floor. The tray surface 110 rests at a certain height above the base surface 402, for example 1 to 6 inches, with 1 to 3 inches being the preferred height. Game fish 501 and game meat 502 are then placed on the tray surface 110, such that the game meat 502 and fish 501 are placed above the base surface 402 of the cooler 400, thereby allowing blood, dirt, grass, liquids, material and other debris to be easily washed from the items. Additionally, the grooves or gaps 202 in the undulating pattern 131 form a curve or arc along a top edge and are present between adjacent or two consecutive supporting legs 130, which helps in the draining of viscous fluids, such as blood 510, to travel beneath the tray surface 110 and onto the base surface 402 towards the draining hole 410. Due to the presence of the grooves 202, the fluid and other debris do not stagnate within the side surfaces of the rack insert 100, allowing continuous drainage of the blood and other debris 510 from the cooler 400.

In this manner, the rack tray insert 100 keeps game meat 502, fish 501 and other items suspended above the blood, hair and other debris, allowing the meat to stay cold and sanitary. The rack tray insert 100 can be commercially available as a standard accessory for coolers or ice chests 400 at the point of manufacture, or as an aftermarket item. The rack or tray insert 100 is ideal for use in the bottom of ice coolers 400 to ensure food safety. It is also a useful item for picnic and camping food storage as well.

Figure 6:
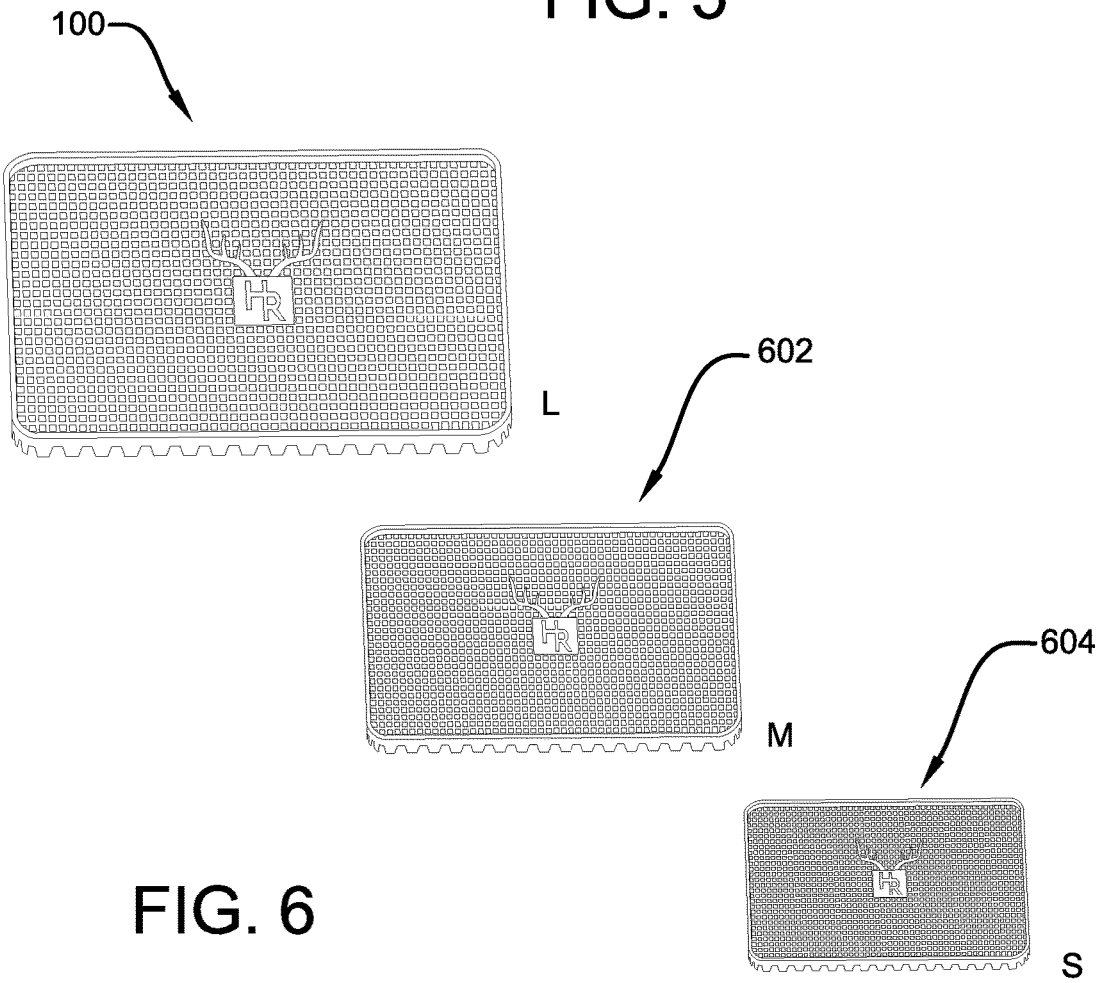
FIG. 6 illustrates a perspective view of the various sizes of the reconfigurable rack insert for a cooler or ice chest of the present invention in accordance with the disclosed architecture.

FIG. 6 illustrates a perspective view of the various sizes of the reconfigurable rack insert 100 for a cooler or ice chest 400 of the present invention in accordance with the disclosed architecture. The rack insert 100 of the present invention is commercially available in different sizes to meet the needs and requirements of different users, as well as the interior configuration of a cooler or ice chest. The insert 100 is designed for large coolers, however other variants 602, 604 are for medium and small sized coolers. The design specifications for each size remain the same with the presence of the drainage gaps 150 along the tray surface 110 and grooves present on the side surfaces for easy draining of blood, water and other debris.

Figure 7:
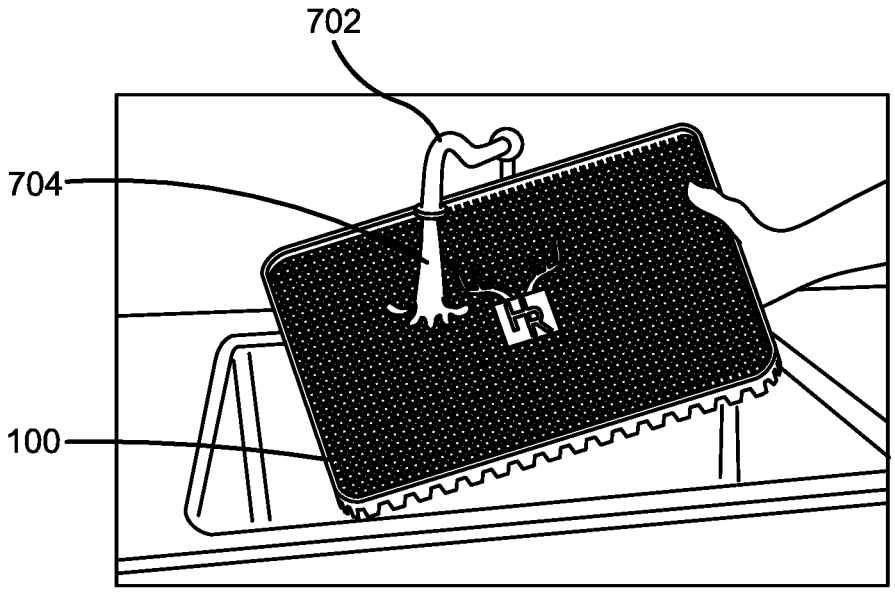
FIG. 7 illustrates a perspective view of one potential embodiment of the novel rack insert for a cooler or ice chest of the present invention being cleaned in a sink with soap and water in accordance with the disclosed architecture.

FIG. 7 illustrates a perspective view of one potential embodiment of the novel rack insert 100 for a cooler or ice chest 400 of the present invention being cleaned in a sink with soap and water in accordance with the disclosed architecture. The rack insert 100 is durable, flexible and washable. The rack tray insert 100 may be comprised of a durable impact resistant plastic, lightweight metal or any other similar material that is both hand washable and dishwasher safe. As shown, the rack insert 100 can be easily washed with soap and water 704 coming from a tap 702.

Figure 8:
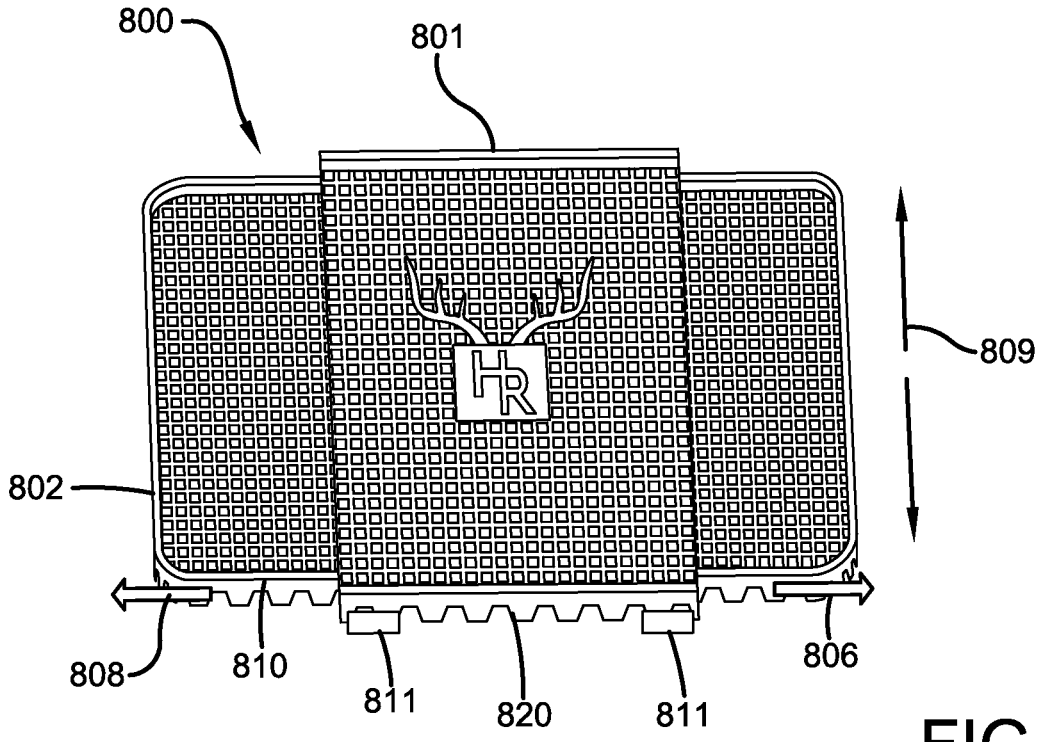
FIG. 8 illustrates a perspective view of one potential embodiment of the novel rack insert for a cooler or ice chest of the present invention in accordance with the disclosed architecture, wherein the reconfigurability of the rack insert is clearly visible.

FIG. 8 illustrates a perspective view of one potential embodiment of the novel rack insert 800 for a cooler or ice chest 400 of the present invention in accordance with the disclosed architecture, wherein the reconfigurability of the rack insert 100 is clearly visible. More specifically, in the present embodiment, an upper portion 801 can slide over the side surface 810 of the lower portion 802 of the rack insert 800. The side surface 820 of the upper portion 801 slides in the longitudinal direction 806, 808 to extend or reduce the overall length of the rack insert 800 to satisfy the needs and requirements of the user, and to fit coolers 400 of various sizes. Likewise, the rack insert 800 may also extend in the transverse direction 809. The length and width of the rack insert 800 in the fully extended state is preferably 150% of the length and width of the rack insert 800 in its normal state. The sliding mechanism is further comprised of one or more locks (not shown), such that the supporting legs of both the upper and lower tray portions coincide with each other upon locking the sliding mechanism.

Additionally, in another embodiment of the present invention, a plurality of flanges 811 may be present on the bottom of the tray insert 800 that can be extended in the vertical direction (i.e., telescoping) to increase the overall height of the rack insert 800 in relation to the base surface of the cooler 400. Further, in one embodiment, a number of different materials, including extruded or molded plastics, polyethylene, aluminum or the like, all with satisfactory results, can be used for making the rack insert 100, 800 of the present invention. The material should not be overly thermally conductive, and should not react with the game meat and fish.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "rack insert", "rack tray insert", "rack tray", "ice chest cooler tray", and "high rack cooler insert" are interchangeable and refer to the rack insert 100, 800 of the present invention.

Notwithstanding the forgoing, the rack insert 100, 800 of the present invention and its various components can be of any suitable size and configuration as is known in the art without affecting the overall concept of the invention, provided that it accomplishes the above stated objectives. One of ordinary skill in the art will appreciate that the size, configuration and material of the rack insert 100, 800 as shown in the FIGS. are for illustrative purposes only, and that many other sizes and shapes of the rack insert 100, 800 are well within the scope of the present disclosure. Although the dimensions of the rack insert 100, 800 are important design parameters for user convenience, the rack insert 100, 800 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An accessory for a cooler comprising:

a tray having a surface and a plurality of sidewalls extending around a periphery of the tray, wherein the tray is shaped to fit within an interior space of the cooler;

the plurality of sidewalls extending perpendicular to the surface of the tray to form an upper sidewall and a lower sidewall;

the surface having a plurality of continuous openings therein; and at least one of the upper and lower sidewalls having a plurality of gaps formed therein; and wherein the tray further comprises a plurality of sensors configured to detect a bacterial level, a duration, and a light exposure.

2. The accessory for a cooler as recited in claim 1, wherein the plurality of gaps form an undulating pattern.

3. The accessory for a cooler as recited in claim 2, wherein the undulating pattern is a continuous pattern and extends around the periphery of the tray.

4. The accessory for a cooler as recited in claim 3, wherein the undulating pattern is in the lower sidewall.

5. The accessory for a cooler as recited in claim 4, wherein each of the plurality of gaps have a narrower top end and a wider bottom end.

6. The accessory for a cooler as recited in claim 5, wherein the narrower top end of each of the plurality of gaps is adjacent the surface of the tray.

7. The accessory for a cooler as recited in claim 6, wherein the wider bottom end is placed on a base of the cooler.

8. The accessory for a cooler as recited in claim 7, wherein the surface of the tray is coated or impregnated with at least one of an anti-microbial material, an anti-fungal material and an anti-bacterial material.

9. The accessory for a cooler as recited in claim 8 further comprising a thermometer.

10. The accessory for a cooler as recited in claim 9, wherein the tray has a rectangular shape and rounded corners.

11. A cooler and removable tray combination comprising:

a cooler having a base, a plurality of walls, a top and a drain opening, wherein the cooler has a geometric shape;

a removable tray sized and configured to fit within the geometric shape of the cooler;

the removable tray having a surface with a plurality of openings therein and a plurality of sidewalls, wherein the plurality of sidewalls extend both above and below the surface of the removable tray; and each of the plurality of sidewalls have an undulating pattern, wherein the undulating pattern includes a plurality of gaps and each of the plurality of gaps are adjacent to a supporting foot; and wherein the removable tray is telescoping in both a longitudinal direction and in a lateral direction and is lockable in the longitudinal direction and the lateral directions at up to 150 percent of a non-telescoped length and width of the removable tray; and wherein a surface of the removable tray is impregnated with an anti-fungal material; and wherein the removable tray further comprises a plurality of flanges extending from a bottom of the removable tray extendable downward to elevate the removable tray.

12. The cooler and removable tray combination as recited in claim 11, wherein each of the plurality of gaps comprise a narrow end and a wide end.

13. The cooler and removable tray combination as recited in claim 12, wherein the wide end of each of the plurality of gaps is adjacent to the supporting foot.

14. The cooler and removable tray combination as recited in claim 13, wherein the removable tray further comprises a thermometer and a sensor.

15. A removable tray insert for use with an ice chest, the removable tray insert comprising:

a rectangular tray sized and configured to fit within an ice chest, the rectangular tray having a surface with a plurality of openings evenly spaced throughout the surface of the rectangular tray;

wherein the rectangular tray comprises sidewalls extending around the periphery of the surface with a portion of the sidewalls extending above the surface and a portion of the sidewalls extending below the surface;

the portion of the sidewalls extending below the surface has an undulating pattern including supporting feet and gaps, with each of the gaps disposed between adjacent supporting feet; and an upper tray comprising a surface with a plurality of openings evenly spaced throughout the surface of the upper tray, a pair of end walls with a portion of each end wall extending above the surface and a portion of each end wall extending below the surface; and wherein the portion of each end wall extending below the surface has an undulating pattern including supporting feet and gaps, with each of the gaps disposed between adjacent supporting feet; and wherein the upper tray is configured to slide over the sidewalls of the rectangular tray in a longitudinal direction; and wherein the upper tray further comprises a plurality of locks configured to secure the upper tray to the rectangular tray at a plurality of positions where the supporting feet of the rectangular tray align with the supporting feet of the upper tray; and wherein the rectangular tray further comprises a plurality of sensors configured to detect a duration and a light exposure.

16. The removable tray insert for use with an ice chest as recited in claim 15, wherein the plurality of openings are square or rectangular in shape and have a size ranging from ½" to 1".

* * * * *